US005528873A

United States Patent [19]

Correia et al.

[11] Patent Number: 5,528,873

[45] Date of Patent: Jun. 25, 1996

[54] BLOCK FOR CONSTRUCTION RETAINING WALL

[76] Inventors: Horacio Correia, 1675 Rougemont; Charles Ciccarello, 8750 San Francisco, both of Brossard, Quebec, Canada

[21] Appl. No.: 192,604

[22] Filed: Feb. 7, 1994

[51] Int. Cl.[6] ..... E04B 5/04

[52] U.S. Cl. ..... 52/605; 52/609; 405/284; 405/286

[58] Field of Search ..... 52/605–609, 585.1, 52/592.6; 405/282, 284–286

[56] References Cited

U.S. PATENT DOCUMENTS

| | | | |
|---|---|---|---|
| 4,384,810 | 5/1983 | Neumann | 405/284 |
| 4,661,023 | 4/1987 | Hilfiker | 405/286 X |
| 4,684,294 | 8/1987 | O'Neill | 405/286 |
| 4,884,921 | 12/1989 | Smith | 405/286 |
| 5,282,700 | 2/1994 | Rodrigue | 52/605 X |

*Primary Examiner*—Carl D. Friedman
*Assistant Examiner*—Beth A. Aubrey
*Attorney, Agent, or Firm*—Swabey Ogilvy Renault; Guy J. Houle

[57] ABSTRACT

A block for constructing a retaining wall and wherein the block is formed as an elongated rectangular block having opposed flat top and bottom surfaces, a front end wall and a rear end wall. An elongated connector receiving recess is provided in the top and bottom walls and extends along the longitudinal axis of the block and the recesses are disposed opposite one another in an offset and overlapping relationship. A connector element is received between juxtaposed recesses when blocks are stacked one on top of each oiLher to form a retaining wall and wherein the connector element prevents transverse displacement of the blocks. The blocks are stacked with predetermined ones of the top or bottom surfaces juxtaposed whereby to erect retaining walls having a straight or inclined front face or portions thereof.

9 Claims, 2 Drawing Sheets

BLOCK FOR CONSTRUCTION RETAINING WALL

TECHNICAL FIELD

The present invention relates to a construction block, and preferably a precast concrete block, for the construction of retaining walls and wherein the block has opposed flat top and bottom surfaces with an elongated connector receiving recess therein and wherein the recesses in the opposed top and bottom surfaces are disposed opposite one another in an offset and overlapping relationship to receive a connector element therein whereby the blocks may be stacked one on top of each other to erect retaining walls having a straight or inclined front face or portions thereof.

BACKGROUND OF INVENTION

The building block of the present invention is for use in the erection of retaining walls and utilizes an interconnecting system of the general type as disclosed in U.S. Pat. No. 4,512,685 issued Apr. 23, 1985. In that Patent, there is disclosed a building block having a specifically configured inclined frontal section and a substantially rectangular rear section having opposed aligned recesses so that when the blocks are juxtaposed, one on top of the other, these may be interconnected by a precast concrete beam of rectangular cross-section extending in juxtaposed recesses. These blocks are utilized to erect retaining walls which are oriented vertically or in an inclined manner. The angle of the retaining wall is predicated by the manner in which the first one of the blocks is disposed to form the footing. The block may be disposed horizontally in an upright or inverted manner whereby to form a vertical or inclined wall or the foundation block may be disposed at an angle within a ground surface to form a straight wall. The interconnecting beams may also be attached to anchors disposed rearwardly in the fill behind the retaining wall.

A disadvantage of these blocks is that they have an awkward cross-sectional configuration and are difficult and expensive to cast. They are also not easily stackable or storable one on top of the other as they must be oriented in a specific manner in order to do so.

SUMMARY OF INVENTION

It is a feature of the present invention to provide a block for constructing a retaining wall which block is simple in construction and easy to use for the erection of retaining walls regardless if the blocks are used to form retaining walls which are straight, inclined, or straight with inclined portions.

Another feature of the present invention is to provide a block for constructing a retaining wall and wherein the block is of a generally rectangular configuration and provided with one or more connector receiving recesses in the top and bottom surfaces thereof with at least one of the recesses in the top and bottom surfaces being disposed opposite one another in an offset and overlapping relationship whereby inclined or straight walls may be provided by juxtaposing either the bottom surface of one row of blocks with the top surface of the other or the top surface of one row of blocks with the inverted top surface of the other row.

According to the above features, from a broad aspect, the present invention provides a block for constructing a retaining wall. The block is an elongated rectangular block having opposed flat top and bottom surfaces, a front side wall and a rear side wall and end wall. An elongated connector receiving recess is provided in the top and bottom walls. Each of the recesses extends along a longitudinal axis of the rectangular block and has a bottom wall, opposed side walls and. an open top end. The connector receiving recess of the top and bottom wall are disposed opposite one another in an offset and overlapping relationship. The recess is configured to receive a portion of a connector element therein. The blocks, when stacked on top of one another to form a retaining wall, have their recesses juxtaposed. One or more of the connector elements are disposed in and between the juxtaposed recesses to retain the blocks aligned longitudinally and to prevent transverse displacement of the blocks. The blocks are stacked with rows of blocks having predetermined ones of the top or bottom surfaces juxtaposed whereby to erect retaining walls having a straight or inclined front face or portions thereof being inclined.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
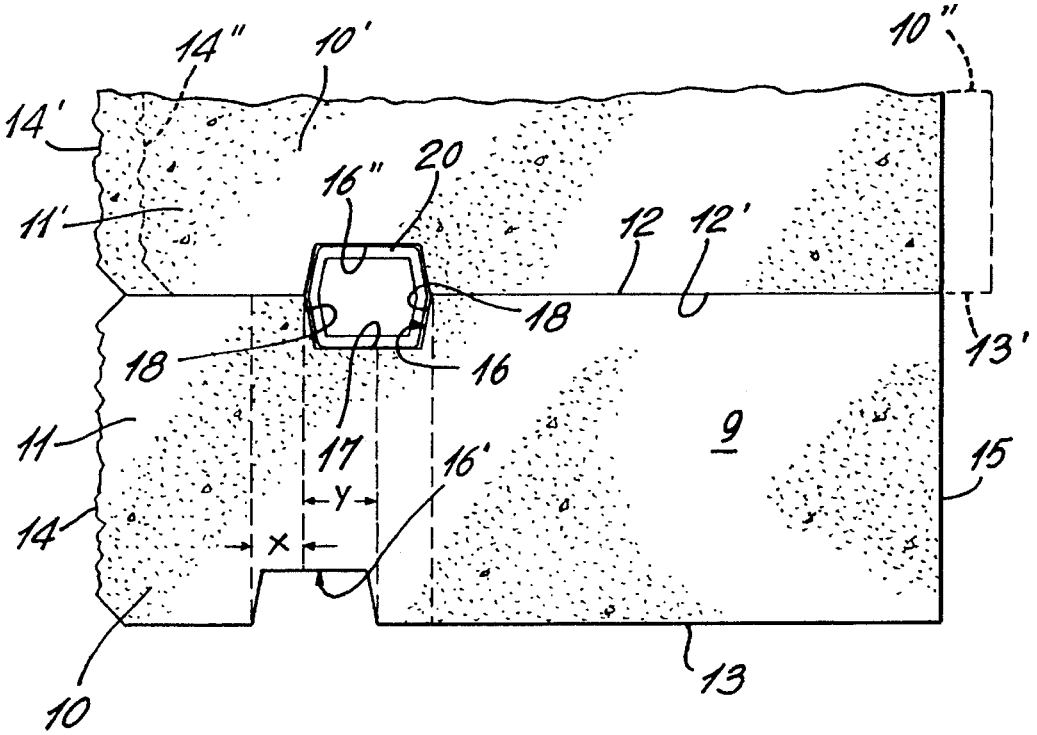
FIG. 1 is an end view showing an elongated rectangular block constructed in accordance with the present invention and showing another like block stacked thereon to form a straight or inclined retaining wall.

Referring now to the drawings, and more particularly to FIG. 1, there is shown generally at 10, an elongated rectangular block constructed in accordance with the present invention and used for the construction of retaining walls consisting of stacked rows 11 and 11' of like blocks stacked one on top of the other and oriented in a predetermined manner. As. herein shown, the rectangular block 10 is a precast concrete block having opposed flat top and bottom surfaces 12 and 13, respectively. The block also defines a front side wall 14 and a rear side wall 15. The block has opposed end walls 9. An elongated connector receiving recess 16 and 16' is disposed respectively in the top and bottom surfaces 12 and 13. The recesses extend along the longitudinal axis of the rectangular blocks and has a bottom wall 17 and opposed side walls 18. The recesses also have an open top end opening in the top and bottom surfaces respectively.

Figure 3:
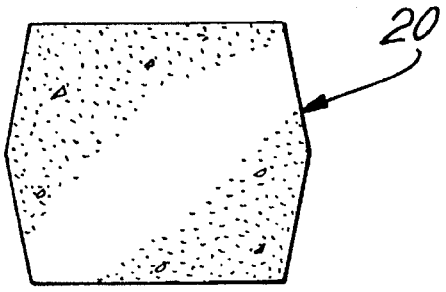
FIG. 3 is an end view of a connector element which is received in juxtaposed connector receiving recesses to maintain the blocks in alignment and to prevent rows of blocks from transverse displacement with respect to one another.

As can be seen, the connector receiving recess 16 in the top surface 12 is disposed opposite the bottom recess 16' in transverse alignment and offset rearwardly, a greater distance from the front side wall 14 than the bottom connector receiving surface, said greater distance being identified at "X". These recesses 16 and 16' also overlap with one another in the area "Y" which is greater than the offset distance As also shown in FIG. 1, the recesses 16 and 16' have their bottom wall 17 disposed parallel to the top and bottom surfaces 12 and 13 and their side walls are outwardly divergent whereby to define a semihexagonal cross-section. When opposed recesses, such as recess 16 is aligned with the recess 16" in the stack row 11', these recesses form a hexagon to receive therein an elongated connector element 20 which is of hexagonal cross-section, as shown in FIG. 3. The cross-section of the connector 20 is slightly smaller than the cross-section of the juxtaposed recesses 16 and 16" whereby not to provide any interference. These connectors 20 prevent transverse displacement of rows of blocks when stacked one on top of each other and keeps them in longitudinal alignment.

As herein shown, in order to erect retaining walls having its front face or the block front side wall 14 aligned, it is necessary to inverse the juxtaposed row, herein row 11', with its top surface 12' disposed on the top surface 12 of the bottom row 11. In this manner, when the recesses 16 and 16" are juxtaposed, the front side walls 14 and 14' of the superposed blocks are disposed in alignment. However, if the retaining wall is to be inclined, or at least portions thereof are to be inclined to provide a design or aesthetic appearance in the retaining wall, the bottom surface 13' of the top row 11' of blocks 10' are juxtaposed with the top surface 12 of the bottom row 11 of blocks 10. Because the recesses 16' are spaced closer to the front side wall 14, this will cause the front side wall 14" of the block 10" to be offset rearwardly a predetermined distance all along the wall, as shown in phantom lines in FIG. 1. In assembling these blocks to form retaining walls, it is firstly necessary to align the bottom row 11 of blocks 10. Connectors 20 are then disposed in the top connector receiving recess 16 and preferably overlapping end joints (not shown) and formed at adjacent ends of adjacent blocks. The second row 11' of blocks 10' is then disposed over the bottom row with the top or bottom surfaces 12' or 13' thereof juxtaposed with the top surface 12 of the bottom row 11, depending if the top row is to be aligned with the bottom row or offset, as demonstrated by the top rows' block front faces 14' or 14".

Figure 2:
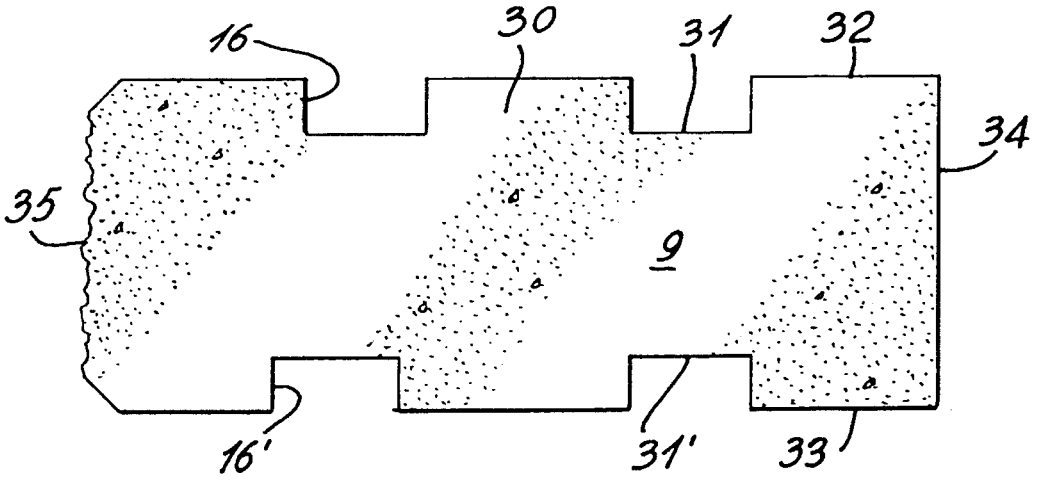
FIG. 2 is an end view of a block constructed in accordance with the present invention and wherein a pair of recesses are provided in both the top and bottom surfaces of the block with one recess of each pair of recesses being disposed in an offset and overlapping relationship and the other recess of each pair being aligned.

Referring now to FIG. 2, there is shown a further variant of the block 10 shown in FIG. 1. As herein shown, the block 30 is formed with an additional connector receiving recess 31 and 31' disposed in the top and bottom surfaces 32 and 33, respectively, of the block 30 and spaced a predetermined distance adjacent the rear side wall 34. These additional connector receiving recesses 31 and 31' are disposed in opposed aligned relationship and are provided to show an alternative interconnecting system wherein it is not necessary to invert the blocks in adjacent rows whereby to provide a straight retaining wall. The other connector receiving recess 16 and 16' are disposed in a similar manner as the block 10, illustrated in FIG. 1. As herein shown, the top connector receiving recess 16 is set back from the front side wall 35 a greater distance than the bottom connector receiving recess 16', as previously described.

Figure 4:
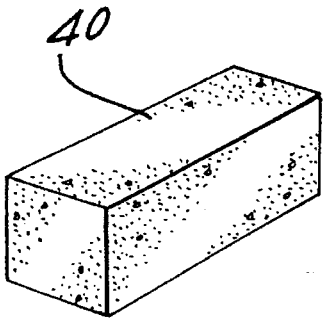
FIG. 4 is a perspective view showing the construction of an alternative connector element for interconnecting rows of blocks having connector receiving recesses of rectangular cross-section.

As also herein shown, the recesses 16, 16', 31 and 31' may be of rectangular cross-section or other suitable cross-section whereby to receive a portion of an elongated connector element or connector block 40 (see FIG. 4) of square cross-section. Of course, the connector block 40 is of slightly smaller cross-section than the cross-section of juxtaposed recesses 16, 16', 31 or 31' provided in juxtaposed blocks to ensure that the connectors cause no interference with the stacking of the blocks on top of one another.

Figure 5A:
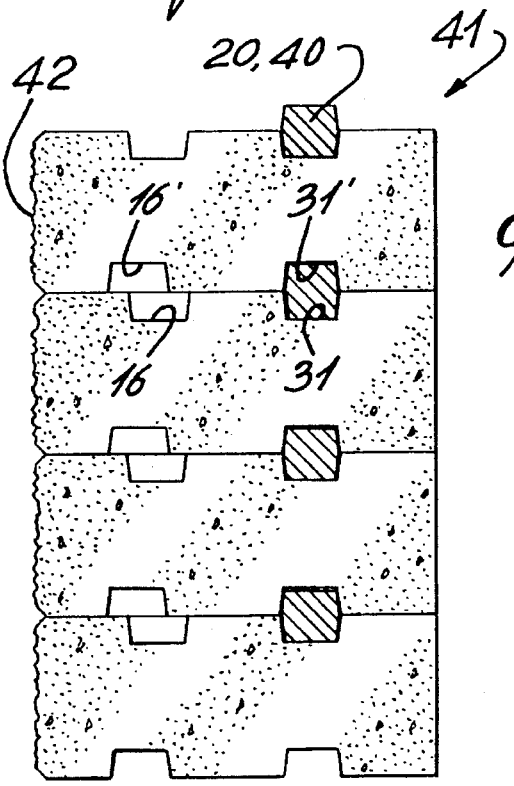
FIGS. 5A and 5B are end views showing rows of blocks of the present invention stacked one on top of each other to form vertical or inclined retaining walls.
Figure 5B:
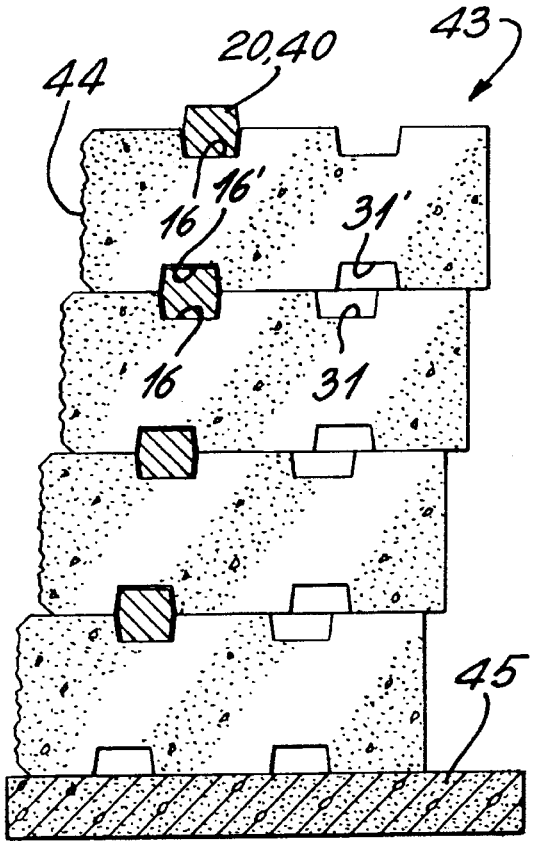

Referring now to FIGS. 5A and 5B, there is shown the manner in which the blocks 30 are stacked whereby to provide a retaining wall 41 having a straight front face 42 or a retaining wall 43 having an inclined front face 44. If the blocks are to have a straight front face 42, then the connectors 20 or 40 are disposed in juxtaposed and aligned ones of the additional connector receiving recesses 31 and 31', as shown in FIG. 5A. No connectors are provided in the frontal recesses 16 and 16' which are offset. If the retaining wall is to be inclined or at least have portions thereof inclined, then the connectors 20 or 40 are disposed in the frontal recesses 16 and 16', in the inclined portions, which are disposed in juxtaposed alignment, as shown in FIG. 5A and the recesses 31 and 31' are offset. These retaining walls 41 or 43 may be disposed on a precast concrete foundation 45, as shown in FIG. 5B, or other suitable flat foundations.

It is within the ambit of the present invention to provide any obvious modifications of the embodiment described herein, provided such modifications fall within the scope of the appended claims.

We claim:

1. A block for constructing a retaining wall, said block comprising an elongated rectangular block having opposed flat top and bottom surfaces, a front side wall and a rear side wall and end walls; a pair of elongated connector receiving recesses in said top and bottom walls; each said recess extending along a longitudinal axis of said rectangular block and having a bottom wall, opposed side walls, and an open top end; said recesses having substantially identical cross-sections and disposed parallel to one another, one of said connector receiving recesses of said top and bottom wall being disposed opposite one another in an offset and overlapping relationship, the other of said connector receiving recesses of said top and bottom surfaces being disposed in opposed aligned relationship, said recesses being configured to receive a portion of a connector element therein, said block when stacked, on top of one auother to form a retaining wall having one of said pair of recesses aligned with one or more of said connector elements disposed in and between said aligned recesses to retain said blocks aligned longitudinally and to prevent transverse displacement of said blocks, said connector element having a hexagonal cross section such that it is symmetrical on both sides and dimensioned for close fit within aligned ones of said pair of connector receiving recesses of stacked blocks whereby to erect retaining walls having a straight or inclined front face or portions thereof being inclined depending in which of said pair of recesses said connector element is disposed.

2. A wall retaining block as claimed in claim 1 wherein said offset connector receiving recesses are disposed spaced from said front side wall of said block and said additional connector receiving recesses are disposed from said rear side wall.

3. A wall retaining block as claimed in claim 1 wherein said connector receiving recesses extend across said top and bottom surfaces.

4. A wall retaining block as claimed in claim 1 wherein said block is a concrete or the like casted block.

5. A wall retaining block as claimed in claim 1 wherein said recess bottom wall is a flat wall extending parallel to said top and bottom surfaces, said. side walls being outwardly divergent side walls.

6. A wall retaining block as claimed in claim 1 wherein said connector receiving recess is of square cross-section to receive a portion of said connector element which is an elongated rod-like element of square cross-section.

7. A wall retaining block as claimed in claim 1 wherein a plurality of said elongated rectangular blocks are stacked with said top or bottom surfaces in contact, said blocks of adjacent rows being offset along their longitudinal axis to span end joints of blocks disposed in adjacent rows whereby to form a retaining wall with staggered joints.

8. A wall retaining block as claimed in claim 7 wherein said connector receiving recess in said top wall is disposed a greater distance from said front side wall than said connector receiving recess of said bottom wall, said connector receiving recess in said top wall of a bottom row of blocks being aligned by said connectors with said connector receiving recess in a bottom wall of a superimposed top row of blocks to form said retaining wall with an inclined front face.

9. A wall retaining block as claimed in claim 7 wherein said connector receiving recess in said top wall is disposed a greater distance from said front side wall than said connector receiving recess of said bottom wall, said connector receiving recess in said top wall of a bottom row of blocks being aligned by said connectors with said connector receiving recess in a top wall of inverted blocks forming a superimposed top row of blocks to form said retaining wall with a straight front face.

* * * * *